US010808922B1

(12) United States Patent
Hsu

(10) Patent No.: US 10,808,922 B1
(45) Date of Patent: Oct. 20, 2020

(54) SOUND RECESSED LIGHT ASSEMBLY WITH HIDDEN SPEAKER

(71) Applicant: Dong Guan Jia Sheng Lighting Technology Co., Ltd. China, Dong-Guna, Guang-Dong (CN)

(72) Inventor: Kevin Hsu, Taichung (TW)

(73) Assignee: Dong Guan Jia Sheng Lighting Technology Co., Ltd. China, Guang-Dong (CN)

( * ) Notice: Subject to any disclaimer, the term of this patent is extended or adjusted under 35 U.S.C. 154(b) by 0 days.

(21) Appl. No.: 16/733,342

(22) Filed: Jan. 3, 2020

(51) Int. Cl.

| | |
|---|---|
| ***F21V 33/00*** | (2006.01) |
| ***F21S 8/02*** | (2006.01) |
| ***F21V 17/14*** | (2006.01) |
| ***H04R 1/02*** | (2006.01) |
| *F21Y 105/18* | (2016.01) |

(52) U.S. Cl.
CPC ..... *F21V 33/0056* (2013.01); *F21S 8/024* (2013.01); *F21S 8/026* (2013.01); *F21V 17/14* (2013.01); *H04R 1/028* (2013.01); *F21Y 2105/18* (2016.08)

(58) Field of Classification Search
CPC .... F21V 33/0056; F21V 17/104; F21V 17/14; F21V 17/18; F21S 8/024; F21S 8/026; F21Y 2105/18; H04R 1/025; H04R 1/028
USPC ..... 362/86
See application file for complete search history.

(56) References Cited

U.S. PATENT DOCUMENTS

| | | | | |
|---|---|---|---|---|
| 8,845,146 | B2 * | 9/2014 | Blankestijn | F21V 19/001 362/373 |
| 10,171,899 | B2 * | 1/2019 | Hsu | H04R 1/028 |
| 2008/0298045 | A1 * | 12/2008 | Wright | F21V 33/0056 362/86 |
| 2011/0080733 | A1 * | 4/2011 | Wang | F21V 21/04 362/253 |
| 2018/0249234 | A1 * | 8/2018 | Zhuang | F21V 29/70 |
| 2019/0113220 | A1 * | 4/2019 | Haase | F21V 29/713 |

* cited by examiner

*Primary Examiner* — Alan B Cariaso
(74) *Attorney, Agent, or Firm* — Karin L. Williams; Mayer & Williams PC

(57) ABSTRACT

A recessed light assembly includes a lighting device, and an acoustics device attached to a ceiling or a wall. The lighting device includes a top board, a light source module, and a lampshade module. The top board is provided with a through hole having a plurality of retaining blocks. The acoustics device has a mounting member having a plurality of retaining slots. Each of the retaining slots has an entrance and a guide portion. Each of the retaining blocks is inserted into the entrance of one of the retaining slots when the top board of the lighting device is moved toward the mounting member, and is inserted into and locked in the guide portion of one of the retaining slots when the top board is rotated relative to the mounting member.

9 Claims, 6 Drawing Sheets

SOUND RECESSED LIGHT ASSEMBLY WITH HIDDEN SPEAKER

BACKGROUND OF THE INVENTION

1. Field of the Invention

The present invention relates to an illuminating apparatus and, more particularly, to a recessed light assembly.

2. Description of the Related Art

A conventional recessed light comprises a lamp body and an acoustics device. The lamp body includes a light source. The acoustics device includes a speaker. Thus, the recessed light has a sounding function. However, the light source is located at the middle of the lamp body, and the sound output port of the speaker is arranged at an outer face of the lamp body, such that the number and the size of the speaker are limited, thereby limiting the sounding effect. In addition, the speaker protrudes from the lamp body, thereby decreasing the aesthetic quality of the conventional recessed light.

BRIEF SUMMARY OF THE INVENTION

The primary objective of the present invention is to provide a sound recessed light assembly with a hidden speaker.

In accordance with the present invention, there is provided a recessed light assembly comprising a lighting device, and an acoustics device. The lighting device includes a top board, a light source module, and a lampshade module. The light source module is mounted on a bottom of the top board. The lampshade module is mounted on the bottom of the top board, and covers the light source module. The top board is provided with a through hole. The through hole of the top board has a periphery provided with a plurality of retaining blocks. The acoustics device has a bottom provided with a mounting member. The mounting member has a periphery provided with a plurality of retaining slots locked onto the retaining blocks of the top board. Each of the retaining slots of the mounting member has an L-shaped arrangement, and has a first end provided with an entrance and a second end provided with a guide portion. The entrance is arranged at an upright state, and the guide portion is arranged at a transverse state. Each of the retaining blocks is inserted into the entrance of one of the retaining slots when the top board of the lighting device is moved toward the mounting member of the acoustics device, and is inserted into and locked in the guide portion of one of the retaining slots when the top board of the lighting device is rotated relative to the mounting member of the acoustics device.

According to the primary advantage of the present invention, the acoustics device is arranged at an inner side of and slightly hidden by the lighting device, without affecting the outer appearance of the lighting device.

According to another advantage of the present invention, the acoustics device is not arranged in the lighting device, such that the size and number of the speaker of the acoustics device are not limited by the size of the lighting device.

According to a further advantage of the present invention, the size and number of the speaker of the acoustics device are set according to the practical requirement, to ensure the sounding effect.

According to a further advantage of the present invention, the acoustics device is arranged at an inner side of the lighting device, without affecting the lighting effect of the lighting device.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
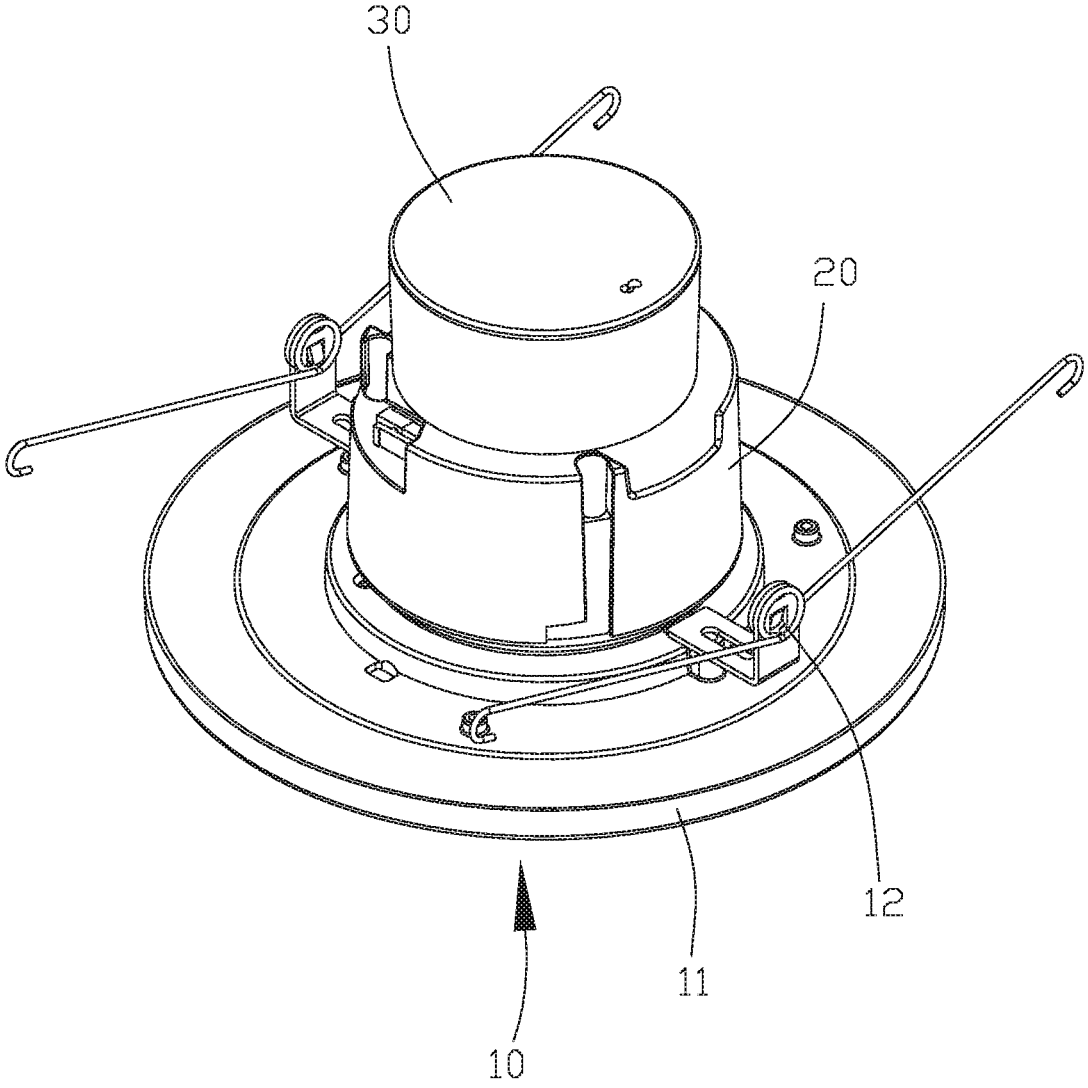
FIG. 1 is a perspective view of a recessed light assembly in accordance with the preferred embodiment of the present invention.
Figure 2:
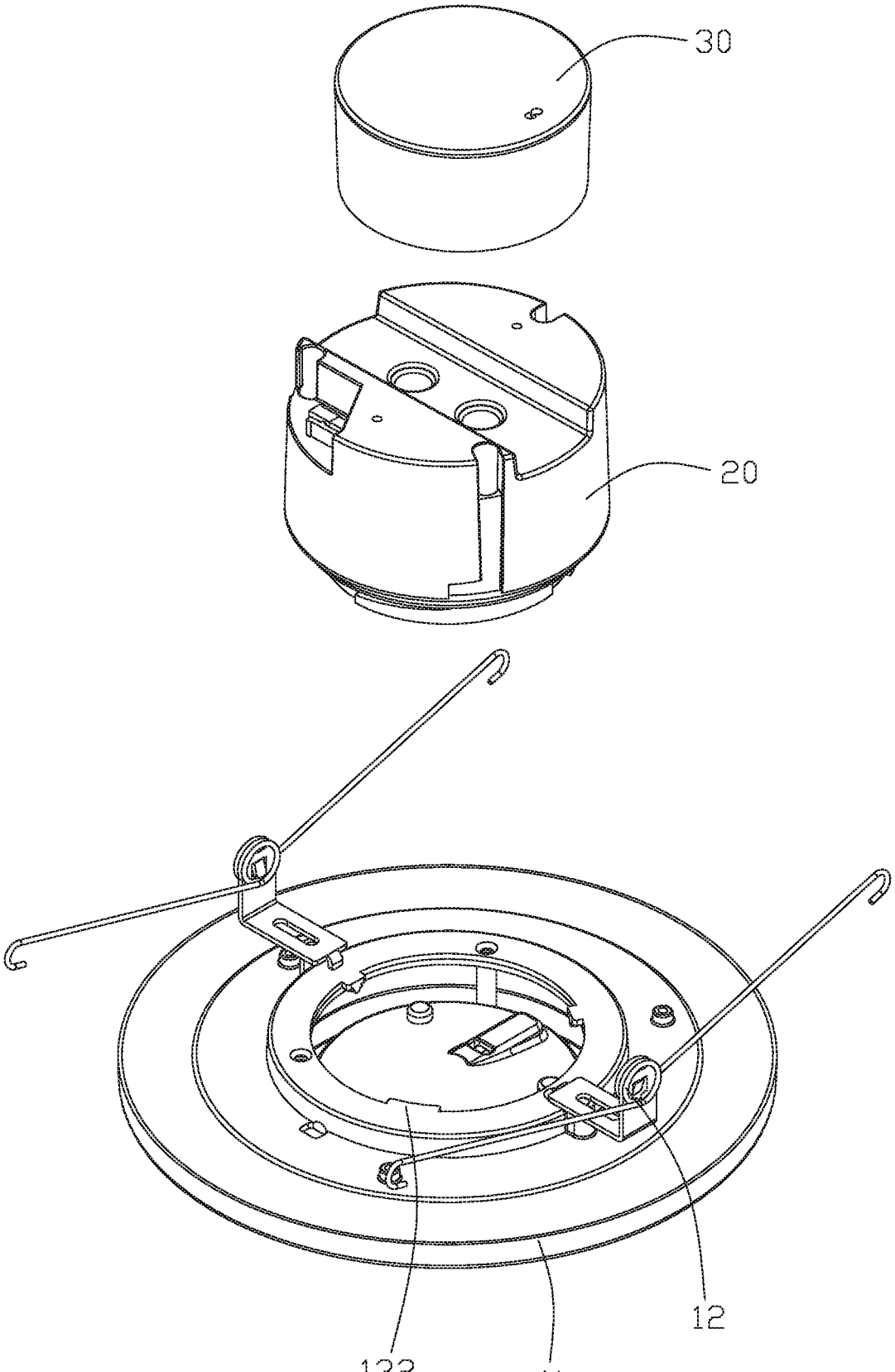
FIG. 2 is a partial exploded perspective view of the recessed light assembly in accordance with the preferred embodiment of the present invention.
Figure 3:
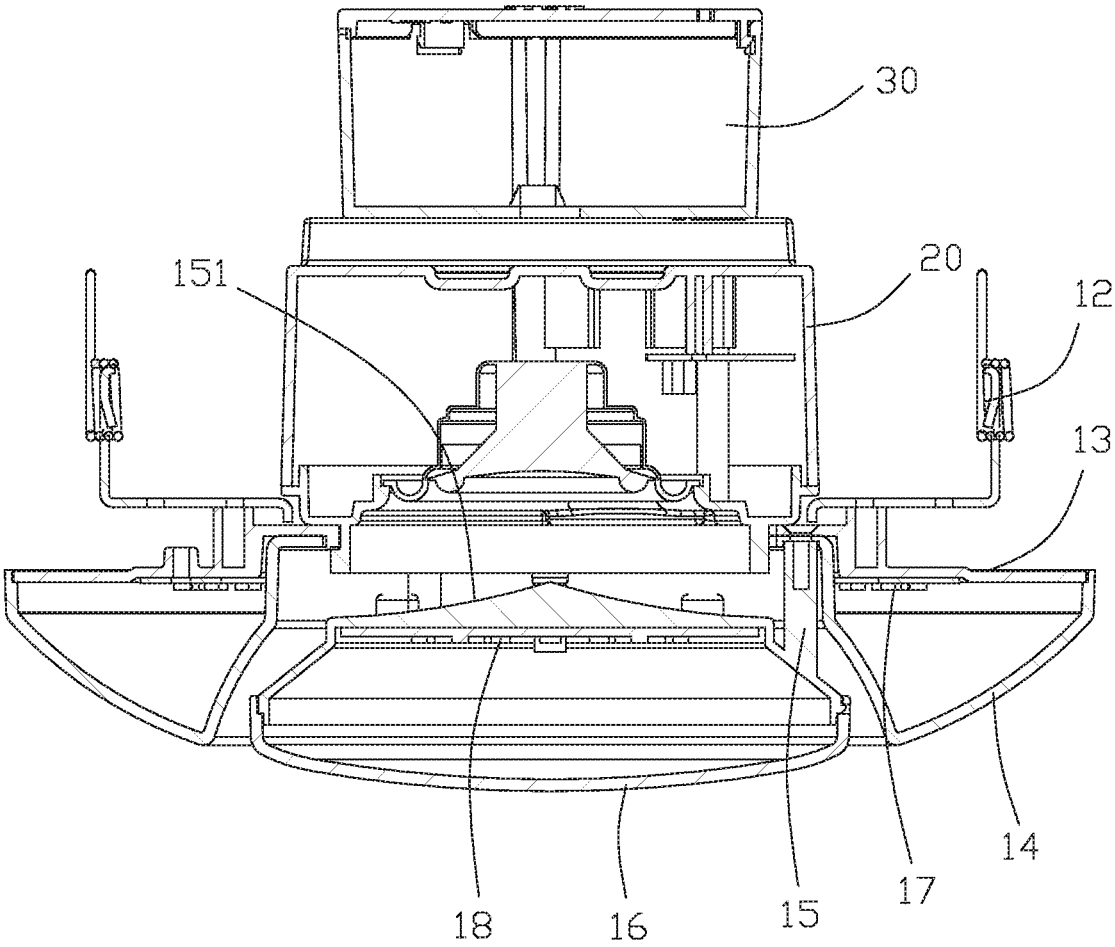
FIG. 3 is a cross-sectional view of the recessed light assembly as shown in FIG. 1.
Figure 4:
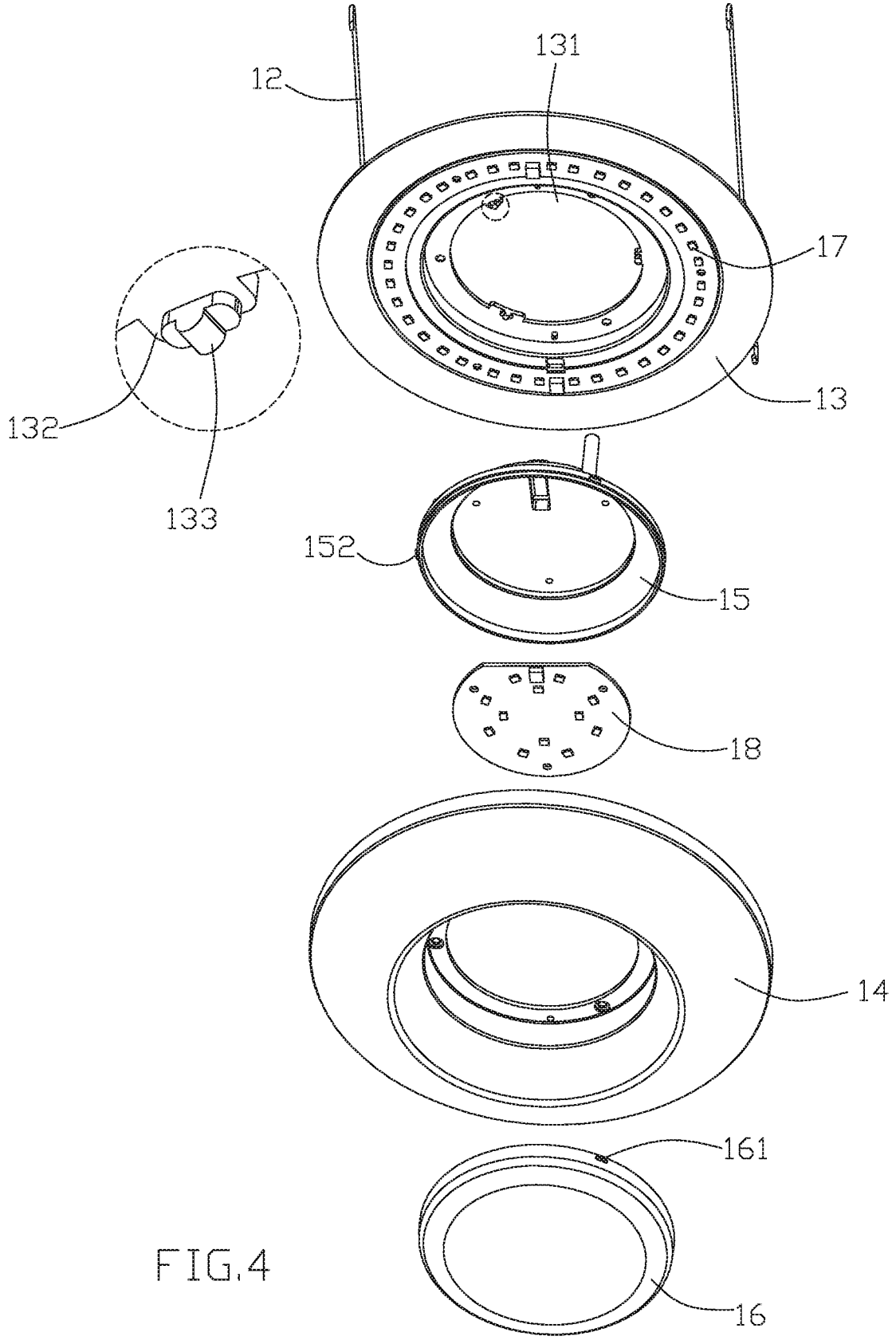
FIG. 4 is a partial exploded perspective view of the recessed light assembly in accordance with the preferred embodiment of the present invention.
Figure 5:
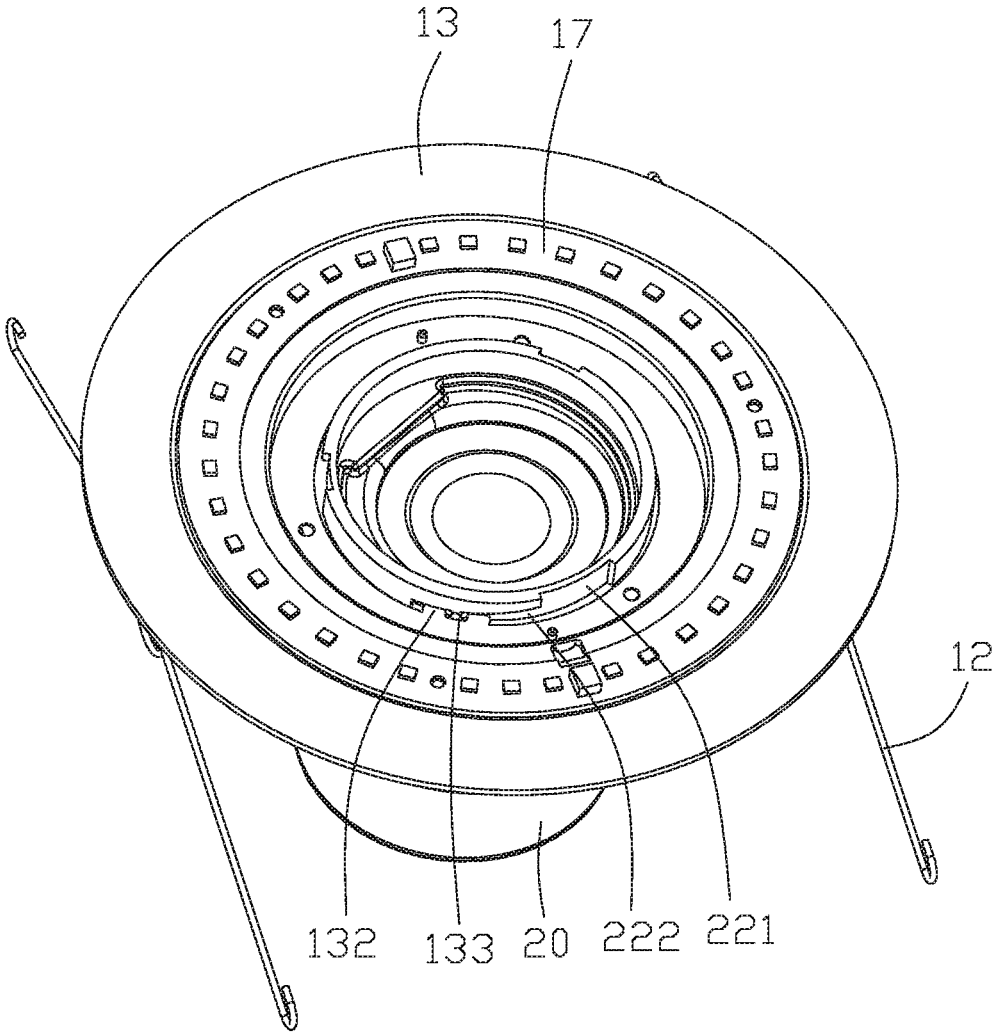
FIG. 5 is a bottom perspective view of the recessed light assembly in accordance with the preferred embodiment of the present invention.
Figure 6:
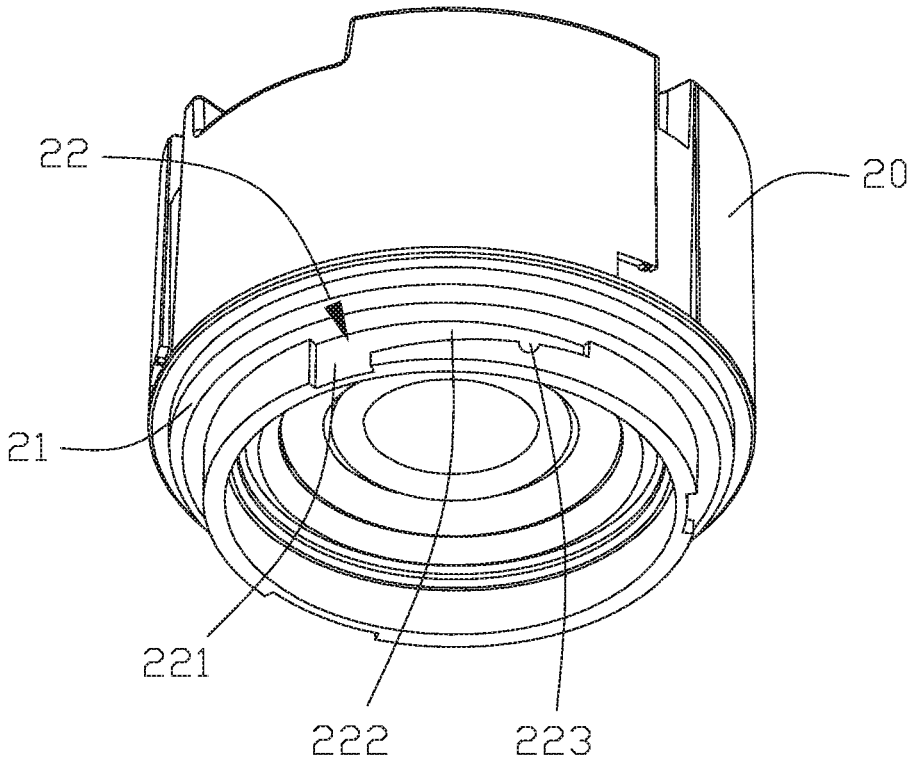
FIG. 6 is a perspective view of an acoustics device of the recessed light assembly in accordance with the preferred embodiment of the present invention.

Referring to FIGS. 1-6, a recessed light assembly in accordance with the preferred embodiment of the present invention comprises a lighting device 10, and an acoustics device 20.

The lighting device 10 includes a top board 13, a light source module, and a lampshade module. The light source module is mounted on a bottom of the top board 13. The lampshade module is mounted on the bottom of the top board 13, and covers the light source module. The top board 13 is provided with a through hole 131 (see FIG. 4). The through hole 131 of the top board 13 has a periphery provided with a plurality of retaining blocks 132.

The acoustics device 20 is connected with the lighting device 10, and mounted on the top board 13 of the lighting device 10. The acoustics device 20 has a bottom provided with a mounting member 21 (see FIG. 6). The mounting member 21 is inserted into the through hole 131 of the top board 13 and has a periphery provided with a plurality of retaining slots 22 locked onto the retaining blocks 132 of the top board 13. Each of the retaining slots 22 of the mounting member 21 has an L-shaped arrangement, and has a first end provided with an entrance 221 and a second end provided with a guide portion 222. The entrance 221 is arranged at an upright state, and the guide portion 222 is arranged at a transverse state. Each of the retaining blocks 132 is inserted into the entrance 221 of one of the retaining slots 22 when the top board 13 of the lighting device 10 is moved toward the mounting member 21 of the acoustics device 20, and is inserted into and locked in the guide portion 222 of one of the retaining slots 22 when the top board 13 of the lighting device 10 is rotated relative to the mounting member 21 of the acoustics device 20.

In the preferred embodiment of the present invention, the guide portion 222 of each of the retaining slots 22 has a bottom provided with a locking groove 223, and each of the retaining blocks 132 has a bottom provided with a locking projection 133 locked in the locking groove 223 of one of the retaining slots 22.

In the preferred embodiment of the present invention, the guide portion 222 of each of the retaining slots 22 has a first end connected to the entrance 221 and a second end connected to the locking groove 223. The bottom of the guide portion 222 of each of the retaining slots 22 rises gradually from the entrance 221 to the locking groove 223. The locking projection 133 of each of the retaining blocks 132 is locked in the locking groove 223 of one of the retaining slots 22 when each of the retaining blocks 132 extends into the second end of the guide portion 222.

In the preferred embodiment of the present invention, the lampshade module includes an outer lampshade 14 and an inner lampshade 16 arranged in the outer lampshade 14. The light source module includes an outer light source 17 and an inner light source 18 arranged in the outer light source 17. The outer lampshade 14 is mounted on the top board 13 and covers the outer light source 17. The inner lampshade 16 covers the inner light source 18.

In the preferred embodiment of the present invention, the lighting device 10 further includes a mounting seat 15 mounted on the top board 13 and located in the outer lampshade 14. The mounting seat 15 is received in the through hole 131 of the top board 13. The inner light source 18 is mounted on a bottom of the mounting seat 15.

In the preferred embodiment of the present invention, the mounting seat 15 has a top provided with a sound (or voice) guide face 151. The sound guide face 151 rises and tapers gradually from a periphery toward a central position thereof. The sound guide face 151 is provided with a pointed portion at the central position thereof. The acoustics device 20 is provided with a speaker corresponding to the pointed portion of the sound guide face 151 to facilitate diffusion of the sound emitted from the acoustics device 20.

In the preferred embodiment of the present invention, the inner lampshade 16 has a periphery provided with a plurality of positioning holes 161, and the mounting seat 15 has a periphery provided with a plurality of positioning pieces 152 mounted in the positioning holes 161 respectively, to secure the inner lampshade 16 to the mounting seat 15.

In the preferred embodiment of the present invention, the lighting device 10 further includes two elastic fitting members 12 mounted on a top of the top board 13. The two elastic fitting members 12 are arranged symmetrically.

In the preferred embodiment of the present invention, the recessed light assembly further comprises a junction (or connecting) box 30 mounted on the acoustics device 20, and attached to a ceiling or a wall. The junction box 30 is electrically connected with the lighting device 10 and the acoustics device 20 by electric cords.

In the preferred embodiment of the present invention, the top board 13, the outer lampshade 14, the mounting seat 15, the inner lampshade 16, the outer light source 17, and the inner light source 18 construct a lamp body, and the two elastic fitting members 12 are mounted on the lamp body.

In the preferred embodiment of the present invention, the outer lampshade 14 is mounted on the bottom of the top board 13. The outer lampshade 14 and the top board 13 form an annular receiving space, and the outer light source 17 is mounted on the bottom of the top board 13, and arranged in the annular receiving space. The top board 13 has an annular arrangement, and the outer lampshade 14 has an annular arrangement.

In the preferred embodiment of the present invention, the inner lampshade 16 covers the bottom of the mounting seat 15. The inner lampshade 16 and the mounting seat 15 form a receiving space, and the inner light source 18 is arranged in the receiving space.

In the preferred embodiment of the present invention, the top board 13, the outer lampshade 14, and the mounting seat 15 are connected by screws.

In assembly, when the top board 13 of the lighting device 10 is moved toward the mounting member 21 of the acoustics device 20, each of the retaining blocks 132 of the top board 13 is inserted into the entrance 221 of one of the retaining slots 22. When the top board 13 of the lighting device 10 is rotated relative to the mounting member 21 of the acoustics device 20, each of the retaining blocks 132 of the top board 13 is inserted into the guide portion 222 of one of the retaining slots 22, and the locking projection 133 of each of the retaining blocks 132 is moved to align with the locking groove 223 of one of the retaining slots 22. Then, the locking projection 133 of each of the retaining blocks 132 is inserted into and locked in the locking groove 223 of one of the retaining slots 22 by the gravity of the lighting device 10. Thus, the lighting device 10 and the acoustics device 20 are assembled and locked.

Accordingly, the acoustics device 20 is arranged at an inner side of and slightly hidden by the lighting device 10, without affecting the outer appearance of the lighting device 10. In addition, the acoustics device 20 is not arranged in the lighting device 10, such that the size and number of the speaker of the acoustics device 20 are not limited by the size of the lighting device 10. Further, the size and number of the speaker of the acoustics device 20 are set according to the practical requirement, to ensure the sounding effect. Further, the acoustics device 20 is arranged at an inner side of the lighting device 10, without affecting the lighting effect of the lighting device 10.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A recessed light assembly comprising:

a lighting device, and an acoustics device;

wherein:

the lighting device includes a top board, a light source module, and a lampshade module;

the light source module is mounted on a bottom of the top board;

the lampshade module is mounted on the bottom of the top board, and covers the light source module;

the top board is provided with a through hole;

the through hole of the top board has a periphery provided with a plurality of retaining blocks;

the acoustics device has a bottom provided with a mounting member;

the mounting member has a periphery provided with a plurality of retaining slots locked onto the retaining blocks of the top board;

each of the retaining slots of the mounting member has an L-shaped arrangement, and has a first end provided with an entrance and a second end provided with a guide portion;

the entrance is arranged at an upright state, and the guide portion is arranged at a transverse state; and each of the retaining blocks is inserted into the entrance of one of the retaining slots when the top board of the lighting device is moved toward the mounting member of the acoustics device, and is inserted into and locked in the guide portion of one of the retaining slots when the top board of the lighting device is rotated relative to the mounting member of the acoustics device.

2. The recessed light assembly of claim 1, wherein the guide portion of each of the retaining slots has a bottom provided with a locking groove, and each of the retaining blocks has a bottom provided with a locking projection locked in the locking groove of one of the retaining slots.

3. The recessed light assembly of claim 2, wherein:

the guide portion of each of the retaining slots has a first end connected to the entrance and a second end connected to the locking groove;

the bottom of the guide portion of each of the retaining slots rises gradually from the entrance to the locking groove; and the locking projection of each of the retaining blocks is locked in the locking groove of one of the retaining slots when each of the retaining blocks extends into the second end of the guide portion.

4. The recessed light assembly of claim 1, wherein:

the lampshade module includes an outer lampshade and an inner lampshade arranged in the outer lampshade;

the light source module includes an outer light source and an inner light source arranged in the outer light source;

the outer lampshade is mounted on the top board and covers the outer light source; and the inner lampshade covers the inner light source.

5. The recessed light assembly of claim 4, wherein:

the lighting device further includes a mounting seat mounted on the top board and located in the outer lampshade;

the mounting seat is received in the through hole of the top board; and the inner light source is mounted on a bottom of the mounting seat.

6. The recessed light assembly of claim 5, wherein:

the mounting seat has a top provided with a sound guide face;

the sound guide face rises and tapers gradually from a periphery toward a central position thereof;

the sound guide face is provided with a pointed portion at the central position thereof; and the acoustics device is provided with a speaker corresponding to the sound guide face.

7. The recessed light assembly of claim 5, wherein the inner lampshade has a periphery provided with a plurality of positioning holes, and the mounting seat has a periphery provided with a plurality of positioning pieces mounted in the positioning holes respectively.

8. The recessed light assembly of claim 1, wherein the lighting device further includes two elastic fitting members mounted on a top of the top board, and the two elastic fitting members are arranged symmetrically.

9. The recessed light assembly of claim 1, wherein the recessed light assembly further comprises a junction box mounted on the acoustics device, and the junction box is electrically connected with the lighting device and the acoustics device by electric cords.

* * * * *